US010000979B2

(12) United States Patent
Löher

(10) Patent No.: US 10,000,979 B2
(45) Date of Patent: Jun. 19, 2018

(54) EARTH DRILLING DEVICE AND METHOD

(71) Applicant: TRACTO-TECHNIK GmbH & Co. KG, Lennestadt (DE)

(72) Inventor: Christian Löher, Eslohe (DE)

(73) Assignee: TRACTO-TECHNIK GmbH & Co. KG, Lennestadt (DE)

( * ) Notice: Subject to any disclaimer, the term of this patent is extended or adjusted under 35 U.S.C. 154(b) by 231 days.

(21) Appl. No.: 14/956,962

(22) Filed: Dec. 2, 2015

(65) Prior Publication Data

US 2016/0160583 A1 Jun. 9, 2016

(30) Foreign Application Priority Data

Dec. 5, 2014 (DE) ..... 10 2014 017 936

(51) Int. Cl.

| | |
|---|---|
| ***E21B 19/08*** | (2006.01) |
| ***E21B 19/24*** | (2006.01) |
| ***E21B 7/04*** | (2006.01) |
| ***E21B 19/14*** | (2006.01) |
| ***E21B 7/20*** | (2006.01) |

(52) U.S. Cl.

CPC ..... *E21B 19/08* (2013.01); *E21B 7/046* (2013.01); *E21B 7/20* (2013.01); *E21B 19/14* (2013.01); *E21B 19/24* (2013.01)

(58) Field of Classification Search

CPC ..... E21B 7/046; E21B 19/16

See application file for complete search history.

(56) References Cited

U.S. PATENT DOCUMENTS

| | | | | |
|---|---|---|---|---|
| 2,165,666 | A | 7/1939 | Tilly | |
| 2,268,572 | A | 1/1942 | Curtis | |
| 3,916,500 | A * | 11/1975 | Brown | E21B 19/15 175/85 |
| 6,267,187 | B1 | 7/2001 | Puettmann et al. | |
| 6,298,928 | B1 * | 10/2001 | Penchansky | E21B 7/02 175/162 |
| 2004/0188144 | A1 | 9/2004 | Volkel | |
| 2005/0238463 | A1 * | 10/2005 | Smith | E21B 19/14 414/22.52 |

FOREIGN PATENT DOCUMENTS

| | | | |
|---|---|---|---|
| DE | 101 59 712 | A1 | 1/2003 |
| EP | 0886034 | A2 | 12/1998 |

* cited by examiner

*Primary Examiner* — David J Bagnell
*Assistant Examiner* — Jonathan Malikasim
(74) *Attorney, Agent, or Firm* — Howard IP Law Group, PC

(57) ABSTRACT

An earth drilling device includes a frame and a slide which is movable forward in the feed direction and backwards away from the feed direction. The frame includes a tilting device which causes the slide to incline relative to the frame and the feed axis when the slide is moved backward to the feed direction. An additional drill section may be inserted into the slide when it is inclined, then the slide may be moved forward in the feed direction to feed the additional drill section into the soil. A method for moving a drill section includes moving a slide opposite a feed direction in a frame. A tilting device causes the slide to incline relative to the frame and the feed direction, and an additional drill section is introduced into the slide. Then the slide is moved in the feed direction, feeding the additional drill section into the soil.

14 Claims, 2 Drawing Sheets

EARTH DRILLING DEVICE AND METHOD

CROSS-REFERENCE TO RELATED APPLICATIONS

This application claims priority pursuant to 35 U.S.C. 119(a)-(d) to German Application No. 10 2014 017 936.2 filed Dec. 5, 2014 the subject matter incorporated herein by reference.

FIELD OF INVENTION

The invention relates to an earth drilling device and a method to move drill string sections.

BACKGROUND

Earth drilling devices, in particular horizontal drilling devices, are used to introduce earth drill holes into the soil by trenchless construction for supply and waste lines, for example, or to replace already installed old lines without a trench. To introduce the earth drill hole, generally a drill string having drill string sections is used, wherein the drill string sections are connectable to each other.

The use of a slide that can be moved back and forth in a frame for advancing and/or retracting a drill string is known from EP 0 886 034 B1, for example. The slide has a seat for a drill string section such that the drill string section can be moved in the seat in the direction of a feed axis to create the earth drill hole. The drive acting on the drill string section can act on the drill string section in the seat in a rotational and/or translatory manner.

When advancing a drill string, normally the seat is disconnected from the (drilled) drill string already introduced into the soil, and the slide is moved opposite the feed direction, and a new drill string section to which the already drilled drill string is to be connected, is inserted into the seat of the slide. The slide is moved in the feed direction, and the drill string section is connected to the already drilled drill string, and is introduced further into the soil with the already drilled drill string.

A disadvantage with this is that the compact design of the frame with the slide makes handling difficult when introducing and removing a drill string section from the seat of the slide, in particular when a frame and slide arranged therein are in a trench. Furthermore, the size of the frame and the path of movement of the slide within the frame dictate the maximum size of the drill string sections to be connected to each other, which imposes restrictions even though drill string sections are desired that are as long as possible.

SUMMARY

An object of the invention is therefore to present an improved earth drilling device which allows simplified, improved handling of the drill string sections to be introduced into the soil and/or allows a strict restriction of the length of the drill string sections to a clear length within the frame to be dispensed with. Furthermore, an improved method for connecting drill string sections is created which simplifies the handling of the drill string sections.

A key concept of the invention is to improve the handling of or access to the slide, or the seat of the slide accommodating the drill string to make it possible to access the slide from the side by means of a tilting device that can incline the slide relative to the feed axis while moving back. According to the invention, it was realized for the first time that, contrary to the belief that particular stability and linear guidance of the slide in the frame must be ensured, a tilting device yields benefits to the slide movement which were considered unachievable due to the above preconception. The slide can be inclined to the rear relative to the feed axis.

The tilting device enables the slide to be tilted so that the slide, or the slide seat, can be better accessed from above. Due to the inclination of the slide to the rear, a new drill string to be introduced into the soil can be inserted up to the rear area of the slide without restriction and connected to the seat which, for its part, is connected to the drive. The earth drilling device can be constructed very short, which in particular relates to the extension in the longitudinal direction of the frame. Use within very small trenches becomes possible.

An "earth drilling device" is in particular understood to be any device that moves a drill string having drill string sections within a channel that exists or is to be created in the soil in order to create or expand a hole, in particular a horizontal drill hole (HD), or to pull lines or other long bodies into the soil. The earth drilling device can in particular be a horizontal drilling device. An "earth drilling device" according to the invention comprises a device that drives a drill string and works by displacing soil, and introduces the drill string into the soil in a rotating and/or translatory manner in the direction of the longitudinal axis of the drill string.

According to the present invention, the term "HD" (horizontal drilling) comprises in particular any type of preferably horizontal channels in a body that exist or are to be created, in particular earth channels including earth drill holes, rock drill holes or ground lines as well as underground or above-ground pipelines and water channels that can be produced or pulled in by using a corresponding earth drilling device.

With regard to the subsequently referenced noun, the term "at least one" used in the claims or the description, as well as the indefinite article "a" used in the claims or the description, and the corresponding grammatical forms in terms of gender and declension, are precisely one or more, i.e., two, three, four, etc. of the elements designated by the noun.

According to the invention, the term "feed axis" comprises the axis along which runs the earth drill hole to be created. With regard to the term "feed axis", it is irrelevant whether the drill string is pushed and/or pulled through the soil when creating the earth drill hole. The force acting on the drill string along the earth drill hole to be created can be tractive force and/or compressive force or thrust force. The drill string can be pulled and/or pushed through the soil by means of the slide or the seat arranged in the slide. Furthermore, rotational movement can also be exerted on the drill string about the longitudinal axis.

According to the invention, the term "slide" indicates a body with a seat for a drill string section, wherein the drill string section can be driven in a translatory and/or rotating manner by means of the drill string section seat. In particular, the slide within the frame can be guided along a path for a translatory movement. The slide can lie on a support that is connected to the frame and has resting elements. The support can be profiled, and the resting elements can be designed as rollers. Skids are also possible as the resting elements. The slide can be guided suspended and/or lying on the frame. The slide can thus be a machine element that can be moved along a path, in particular in a purely translatory manner, within the frame.

According to the invention, the term "frame" comprises a box-shaped or cube-shaped structure, the side walls and/or braces or rods of which can transfer pressure, traction as well as bending. The frame according to the invention preferably has a rectangular outline and can be arranged in a trench for creating the earth drill hole. Preferably, the drive unit and slide are arranged in the frame. In order to fix the device in the trench, the frame can be provided with horizontally extendable braces by means of which the recoil forces can be conducted into the soil.

In a preferred embodiment, the tilting device comprises a guide for the slide which is inclined in an end-side area of the frame relative to the feed axis. The inclination of the guide encloses an angle with the feed axis greater than 0° and less than 90°, in particular between 3° to 7°. By means of a guide, a simple design of the tilting device is possible. The slide can be guided on the guide of the tilting device with corresponding elements.

The end-side area of the frame in which the tilting device is formed is preferably located on the end of the frame which is at a distance from the drill hole to be created.

In a preferred embodiment, the guide has two sections which enclose an angle between each other, wherein the two sections can be linear sections. In particular, one of the parallel sections can be formed parallel to the feed axis. Together with the section parallel to the feed axis, the other section encloses an angle greater than 0° and less than 90°.

Preferably, the guide comprises a support which has an inclination in the end-side area. The support can be designed for corresponding elements of the slide. A simple guide for tilting can be achievable by means of a support. A support without a head-side guide of the slide elements can further make it possible to dispense with achieving forced upward guidance; instead, the slide merely rests and is not pushed downward. This can in particular be advantageous when for example due to an operating error of the earth drilling device, the drill string section located in the slide is connected to a drill string section still remaining in the soil. In such an instance, forced guidance would cause the drill string section or the drill string and/or the slide to be damaged. If the slide only lies on a guide, stabilization can be achieved by holding the slide of the drill string in a position in which the slide does not tilt. The tilting device or guide can be designed to be open at the head-side.

Preferably, the guide runs in a plane such that the tilting device or the guide only causes tilting in a vertical direction, and inclination or tilting or pivoting of the slide in a horizontal direction does not occur.

Preferably, the guide has two guide elements at a distance from each other which are aligned parallel to the feed axis. The degree of freedom of the tilting of the tilting device is thus restricted to a tilting in a vertical direction which can restrict the degrees of freedom of guidance, and a simple guidance can be obtained. The guide can be formed or attached to the side walls of the frame normally aligned parallel to the feed axis.

In a preferred embodiment, the guidance of the slide is such that the slide is tilted in the end-side area within a plane which intersects with the feed axis. The number of degrees of freedom of the tilting device or guide can thereby be reduced. Tilting occurs in a vertical direction. Tilting in a horizontal direction can be omitted.

Preferably, the guide is profiled such that the guide can have a profiled support in which the resting elements of the slide, such as rollers, can be guided. A stable run of the slide when moving back and forth can be achieved thanks to the profiling. By means of the profile, guidance with respect to the height of the support or tilting is achievable, and stabilization in the direction of movement along the extension of the guide or support is also possible.

In a preferred embodiment, the distance of the resting elements of the slide supported by the guide in the direction of the feed axis is greater than the length of the inclined guide in the end-side area. When there is an error operating the earth drilling device—a drill string section is in the seat and is simultaneously still connected to a drill string section in the soil—this can cause the drill string section and/or slide to be damaged. Due to the support on the guide, a slide would tilt as a result of gravity when the support is inclined; however, due to the drill string section held in the slide which is still connected to the drill string section located in the soil, the slide is stabilized, and the drill string section and the resting elements of the slide still parallel to the feed axis cause the slide to not tilt. In the event of an error, the slide with its rear resting elements can "float" over the guide.

The invention also creates a method for moving a drill string section, wherein the method has the following steps: Moving a slide to move a drill string section in a frame, wherein the direction is opposite the feed direction; tilting the slide; introducing a drill string section into the tilted slide; and moving the slide with the drill string section in the feed direction.

Preferably, the slide is tilted in an end-side area of the frame, especially preferably at the side opposite the earth drill hole.

The above statements, and likewise the following description of exemplary embodiments, do not constitute a relinquishment of specific embodiments or features.

BRIEF DESCRIPTION OF THE DRAWINGS

The invention is explained in greater detail below based on an exemplary embodiment shown in the drawings.

In the drawings.

DETAILED DESCRIPTION OF PREFERRED EMBODIMENTS

Figure 1:
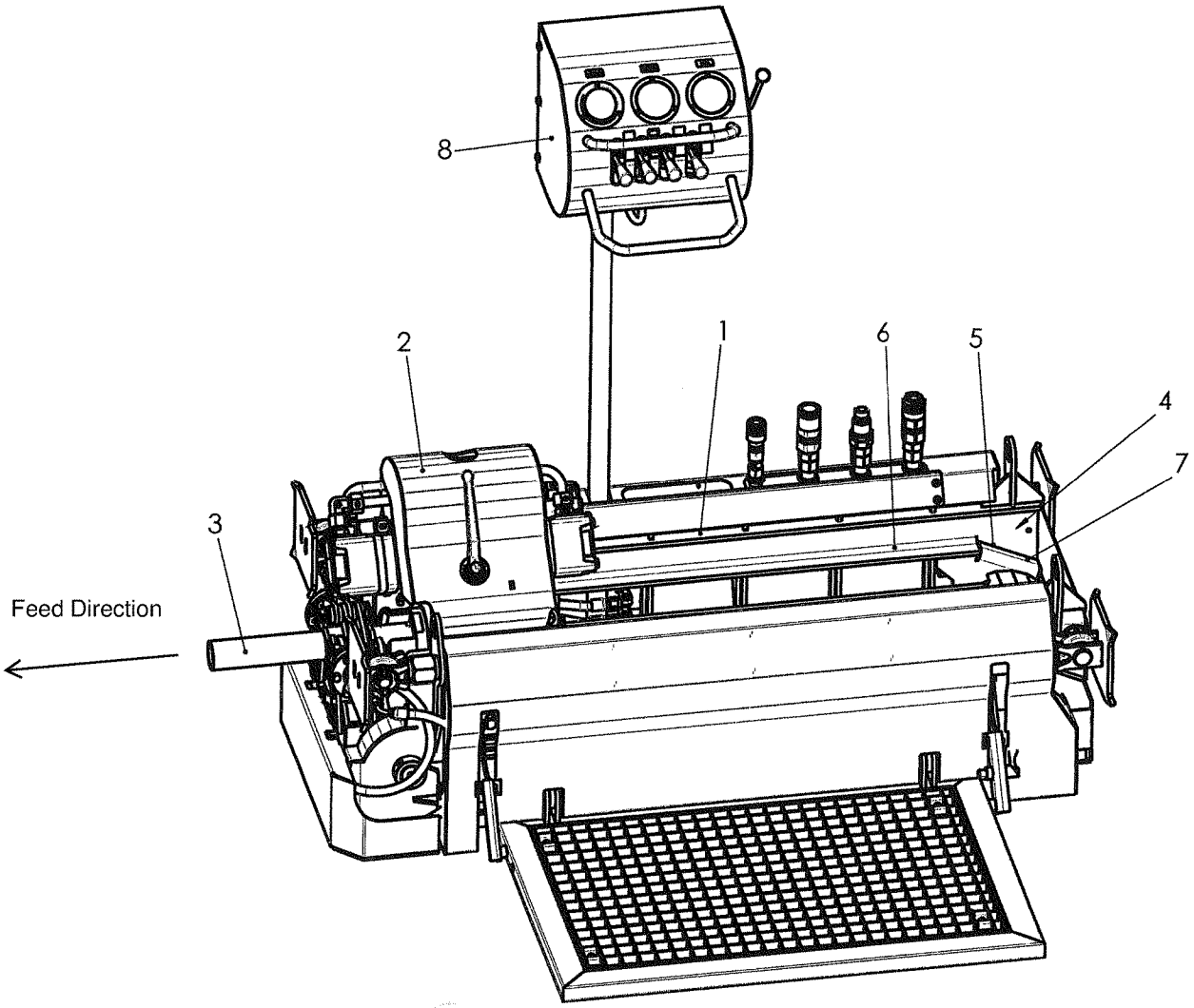
FIG. 1 shows an isometric representation of an earth drilling device with a slide advanced within a frame.

FIG. 1 shows an isometric representation of an earth drilling device. The earth drilling device has a frame 1 which can be arranged in an access or building trench. A slide 2 can be moved back and forth in the frame 1. A hydraulic cylinder can be a drive for the movement.

In the position depicted in FIG. 1, a drill string section 3 is accommodated in a seat of the slide 2 and is drilled into the soil. The drill string section 3 which can be seen in FIG. 1 is located in the soil and in the feed axis of the drill hole to be created.

In order to continue the earth drill hole, the drill string section 3 depicted in FIG. 1 is disconnected from the seat of the slide 2, and the slide 2 is moved back in the frame 1. A tilting device 4 is formed in the frame 1 which causes the slide 2 to incline relative to the feed axis when moving back.

Figure 2:
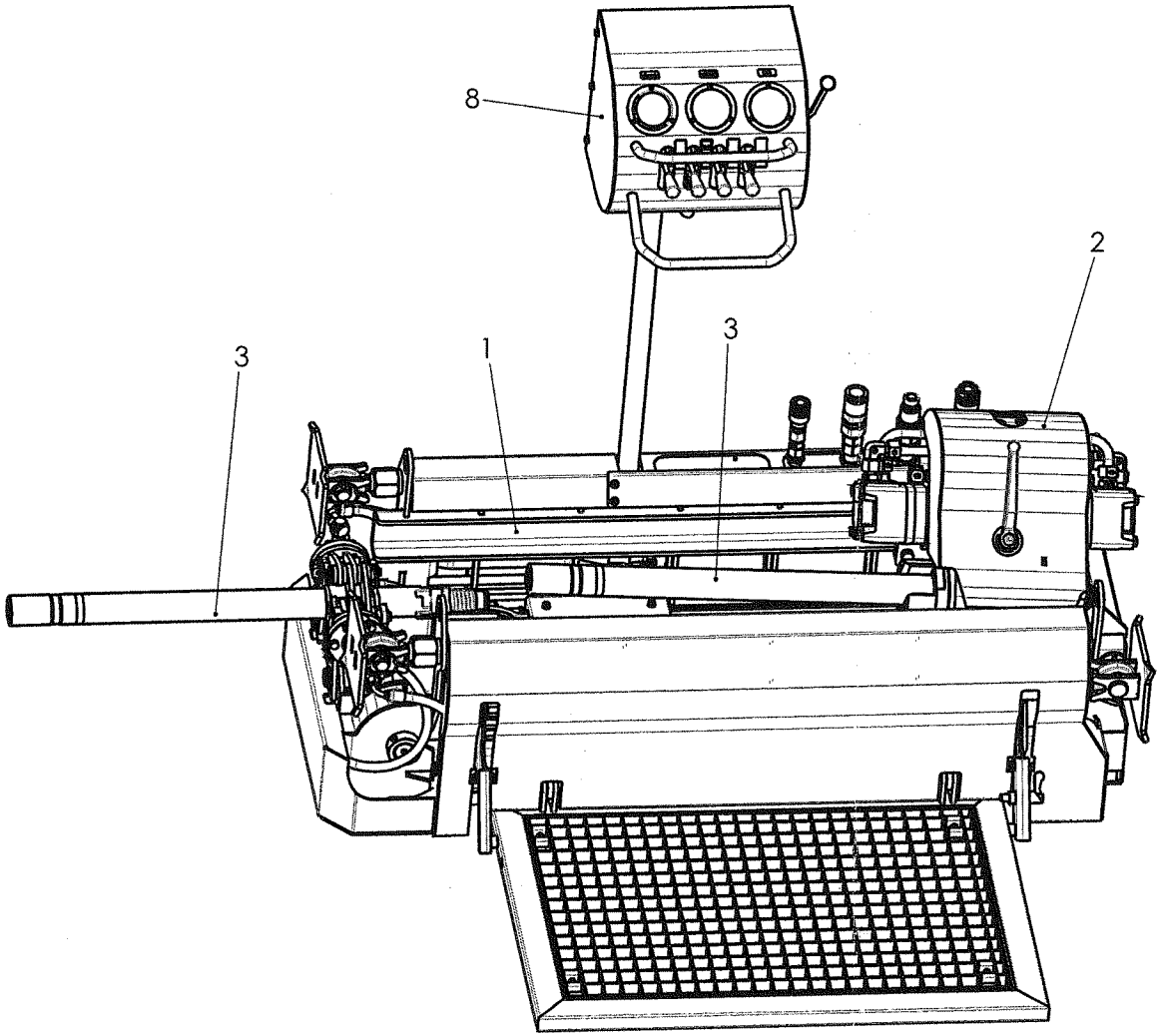
FIG. 2 shows the earth drilling device according to FIG. 1 with a slide that has been moved back within the frame.

FIG. 2 shows the slide 2 inclined relative to the feed axis. The seat of the slide 2 is inclined upward relative to the feed axis, wherein the inclination relative to the feed axis can be 2° to 40°, in particular 3° to 7°. In the position of the slide 2 inclined by means of the tilting device 4, a new drill string section 3 to be introduced into the soil can be inserted in the seat of the slide 2. The slide 2 can then again be moved in the direction of the earth drill hole to be created, and the slide 2 moves out of its inclined position. The drill string section 3 located in the seat of the slide 2 is aligned with the feed axis, and the drill string section 3 located in the seat can be connected to the drill string section 3 already drilled into the soil. The slide 2 can then be moved further in the direction of the new earth drill hole to be created and introduces the drill string section 3 located in the seat into the soil.

The tilting device 4 depicted in FIG. 1 is designed as a guide 5 which inclines the slide 2 relative to the feed axis in an end-side area of the frame 1. In the depicted exemplary embodiment, the guide 5 has two sections 6, 7 which enclose an angle of 3° to 7° between each other. The guide 5 with the sections 6, 7 is designed as a support. The tilting device 4 is formed in the end-side area of the frame 1 at a distance from the earth drill hole to be introduced into the soil.

The guide 5 with the sections 6, 7 runs in a plane. The guide 5 comprises two parallel guide elements at a distance from each other to the left and right of the slide 2. The sections 6 of the guide 5 are aligned parallel to the feed axis.

The guide 5 with sections 6 and 7 is profiled and has a U-shape.

The drilling device can be controlled by a control unit 8 schematically portrayed in FIGS. 1 and 2 which can be arranged outside of the trench. The control unit 8 can have corresponding connecting lines for hydraulic fluid or the like.

The invention claimed is:

1. An earth drilling device comprising:

a frame;

a slide to move a drill string along a feed axis of the frame; and a tilting device in the frame configured to incline the slide relative to the frame and the feed axis;

wherein the slide is movable along the feed axis, backwards opposite a feed direction, and forwards in the feed direction; and wherein the tilting device in the frame causes the slide to incline relative to the frame and the feed axis, responsive to movement of the slide backwards opposite the feed direction.

2. The earth drilling device according to claim 1, wherein the tilting device comprises a guide for the slide which is inclined in an end-side area of the frame relative to the feed axis.

3. The earth drilling device according to claim 2, wherein the guide includes two sections that enclose an angle between each other.

4. The earth drilling device according to claim 3, wherein the two sections of the guide include a first guide section aligned parallel to the feed axis and a second guide section which is inclined in the end-side area of the frame relative to the feed axis; and wherein the slide further includes resting elements, wherein a distance between the resting elements of the slide is greater than a length of the second guide section which is inclined guide in the end-side area.

5. The earth drilling device according to claim 2, wherein the guide includes a support having an inclination in the end-side area.

6. The earth drilling device according to claim 2, wherein the guide runs in a plane.

7. The earth drilling device according to claim 2, wherein the guide has two guide elements at a distance from each other which are aligned parallel to the feed axis.

8. The earth drilling device according to claim 2, wherein the guidance of the slide is such that the slide is pivoted in the end-side area within a plane which intersects the feed axis.

9. The earth drilling device according to claim 2, wherein the guide is profiled.

10. The earth drilling device according to claim 1, further comprising a guide within the frame, wherein the slide is mounted on the guide to move within the frame.

11. The earth drilling device according to claim 1, wherein an orientation of the frame relative to the feed axis remains unchanged during the tilting of the slide.

12. A method for moving a drill string section, comprising:

moving a slide backward in a frame in a direction opposite of a feed direction to a tilting device which causes the slide to incline relative to the frame and the feed direction responsive to the backward movement;

introducing the drill string section into the inclined slide; and moving the slide with the drill string section forward in the feed direction.

13. The method of claim 12, wherein the tilting device causes the slide to incline in an end-side area of the frame relative to the frame and the feed direction.

14. The method of claim 13, wherein the slide is inclined at a side opposite that of an earth drill hole in the frame.

* * * * *